US005446670A

United States Patent [19]

Hunziker

[11] Patent Number: 5,446,670

[45] Date of Patent: Aug. 29, 1995

[54] ERROR MANAGEMENT SYSTEM FOR ERRORS IN IMBRICATED FORMATIONS OF PRINTED PRODUCTS

[75] Inventor: René Hunziker, Wetzikon, Switzerland

[73] Assignee: Ferag AG, Hinwil, Switzerland

[21] Appl. No.: 58,466

[22] Filed: May 6, 1993

[30] Foreign Application Priority Data

May 7, 1992 [CH] Switzerland ..... 01467/92

[51] Int. Cl.[6] ..... G06F 17/60

[52] U.S. Cl. ..... 364/468; 364/478; 364/183; 271/258.04

[58] Field of Search ..... 364/468, 478, 184–187; 270/54, 55, 56; 101/72; 271/262, 263, 258; 192/127, 128, 126; 340/674, 675

[56] References Cited

U.S. PATENT DOCUMENTS 3,899,165 8/1975 Abram et al. ..... 270/54
4,231,567 11/1980 Ziehm .
4,320,894 3/1982 Reist et al. .
4,381,056 7/1989 Eberle .
4,560,159 12/1985 Staub .
4,657,237 4/1987 Hansch ..... 271/178
4,765,502 8/1988 Pintsov et al. ..... 270/55
4,799,661 1/1989 Nail ..... 270/54
4,878,428 11/1989 Watarai .
4,887,809 12/1989 Eberle .
4,949,607 8/1990 Yuito .
5,154,279 10/1992 Hänsch .
5,163,673 11/1992 Heppenstiel ..... 271/263
5,197,382 3/1993 Goodwin ..... 101/72
5,356,130 10/1994 Infanger ..... 271/263

*Primary Examiner*—James P. Trammell
*Attorney, Agent, or Firm*—Bell, Seltzer, Park & Gibson

[57] ABSTRACT

The system for error management for the further processing of an imbricated stream (S) of printed products has an observation element (1), which generates a measuring signal correlated with the imbricated stream. The measuring signal is interpreted clock by clock by an interpretation element (2) by edge and/or amplitude scanning. If a clock of the measuring signal does not have the correct number of edges or a maximum amplitude lying outside a tolerance range, error signals are generated and sent to a control element (3). The control element (3) generates control signals corresponding to the error signals for at least one controlled element (10, 20, 30), which is arranged downstream from the observation element (1) in the stream of products, by delaying the error signal essentially by the distance between observation element (1) and controlled element (10, 20, 30). The controlled element (10, 20, 30) eliminates places where errors have occurred or transforms them into places of different errors. The system serves for detecting, transforming and/or eliminating gaps, places occupied by defective products, places occupied by an incorrect number of products and/or places occupied by products displaced in the conveying direction, of the imbricated stream.

22 Claims, 6 Drawing Sheets

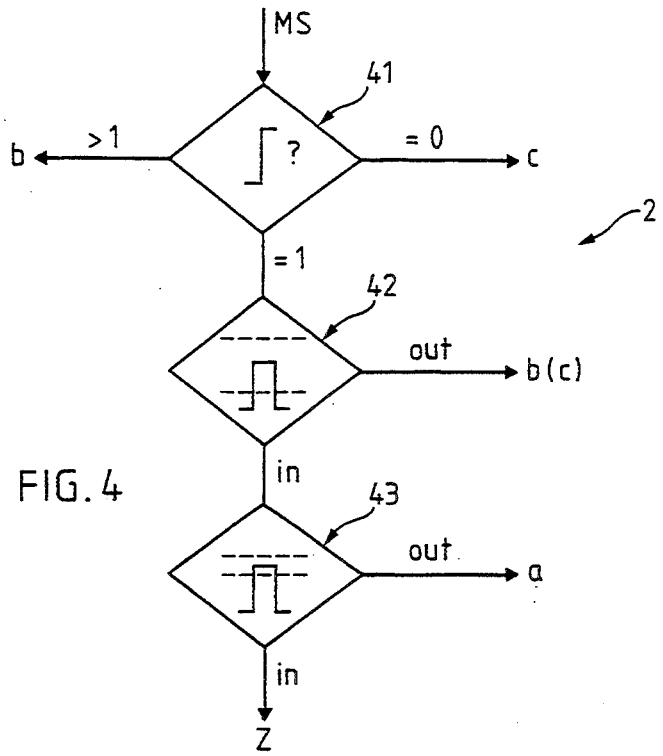
FIG. 4
FIG. 5
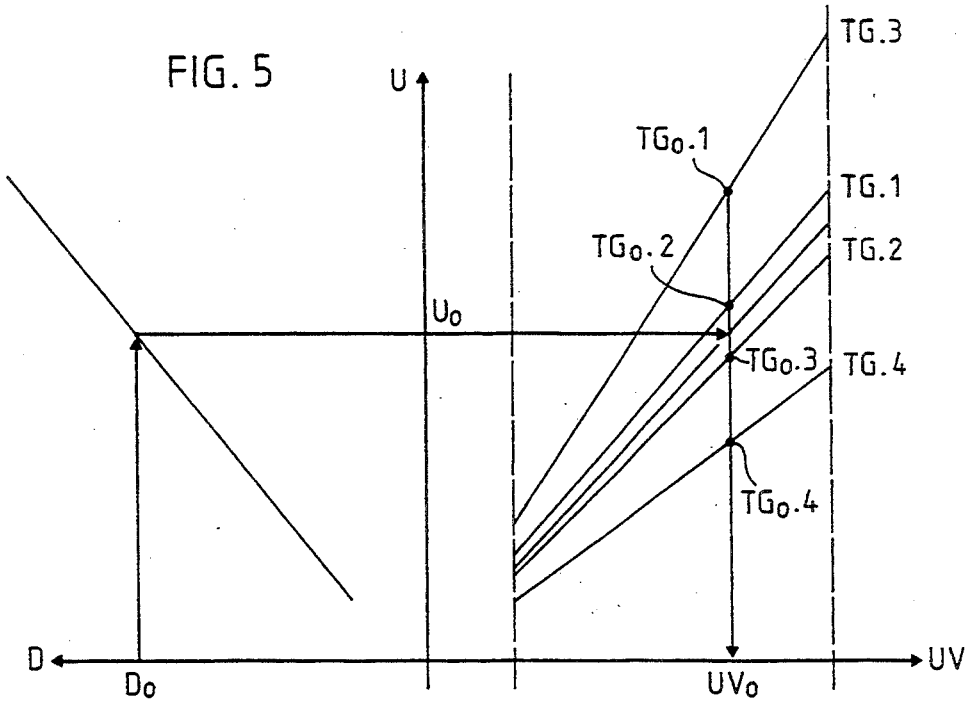

ERROR MANAGEMENT SYSTEM FOR ERRORS IN IMBRICATED FORMATIONS OF PRINTED PRODUCTS

The invention is in the field of the further processing of printed products, in particular printed products in imbricated formations, and relates to a system comprising means and functions for error management of errors in the imbricated formation.

Printed products are delivered in imbricated formation, for example by rotary presses, by unwinding stations from winders or by feeders from stacks. Printed products in imbricated formation are further processed directly in imbricated formation or first of all converted into another transporting formation, for example into a conveying stream of individual printed products hanging from clips, and taken in this form to further processing.

Imbricated streams of printed products include places where errors have occurred, for example in the form of defective products, missing products, displaced products or places occupied by more than one product. Owing to these places where errors have occurred, there arise during further processing for example defective products, gaps in defined product sequences (for example address sequences) or even interruptions in production, which has to be prevented as far as possible.

According to the prior art, errors in imbricated formations are at least partially eliminated by arranging between the apparatus generating an imbricated stream and the apparatus further processing the imbricated stream further apparatuses which, independently of the overall process, are concerned in isolation with eliminating from the imbricated stream places where errors have occurred, in order that an imbricated stream which is as free from errors as possible is available for further processing. An example of such apparatuses are imbrication buffers, by which the gaps in imbricated streams can be closed. Such apparatuses are complex and require space, in particular whenever the imbricated stream also has to be additionally converted for the interposed apparatus. In no case is such an apparatus capable of eliminating all places where errors have occurred, meaning that for highest requirements more than one may be necessary. Since the said apparatuses operate in isolation, they require their own sensor and control systems, which may be very complex. In particular, they are also not suitable for processing differentiated imbricated streams, that is to say imbricated streams with, for example, two different, alternating product spacings.

It is thus the object of the invention to provide an error management system, comprising means and functions, by which places where errors occur in an imbricated formation of printed products which are passed on for further processing are processed with optimized outlay. The error management system is to be capable of being optimized application-specifically in such a way that, with minimal extra outlay on apparatus, it can prevent or restrict to a tolerable extent effects on further processing of places where errors have occurred in the imbricated formation (irrespective of their frequency and type). The system is to be suitable for any type of imbricated stream, that is to say it is to be independent of the type of overlapping (leading edge underneath or on top), the orientation of the products (fold at the front or at the rear) and the thickness of the products and it is, in particular, also to be suitable for differentiated imbricated streams.

This object is achieved by the error management system according to the present invention. The system is to be described with reference to the following figures, in which.

Figure 6:
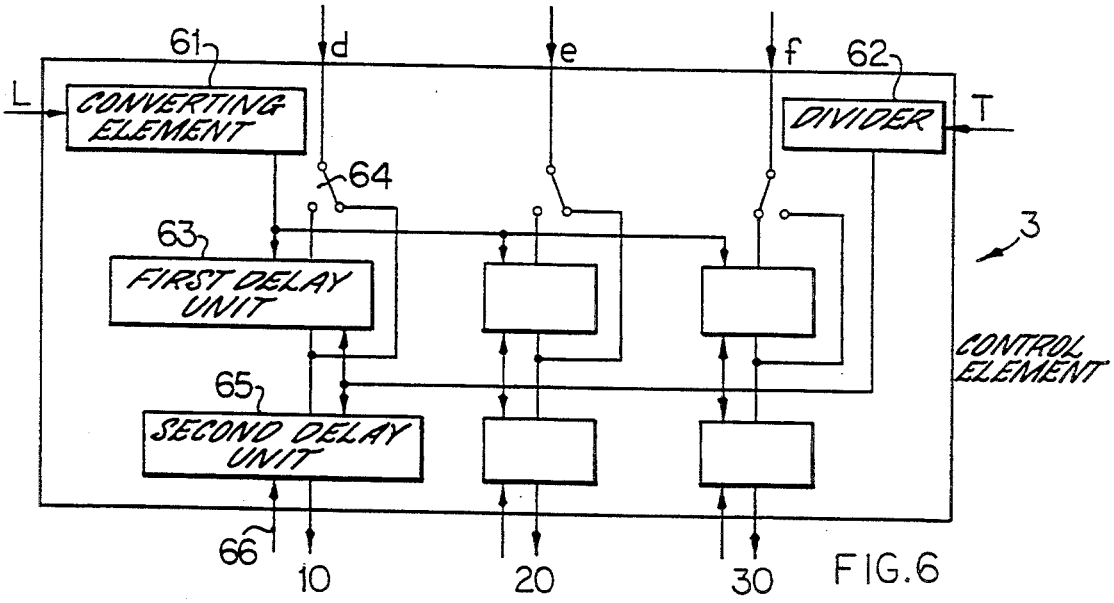
Figure 7:
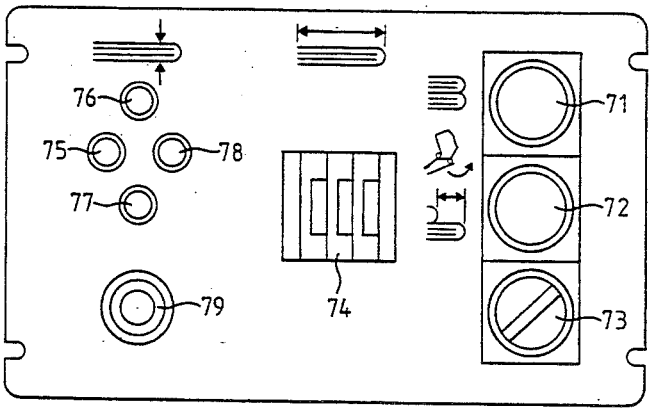
Figure 8:
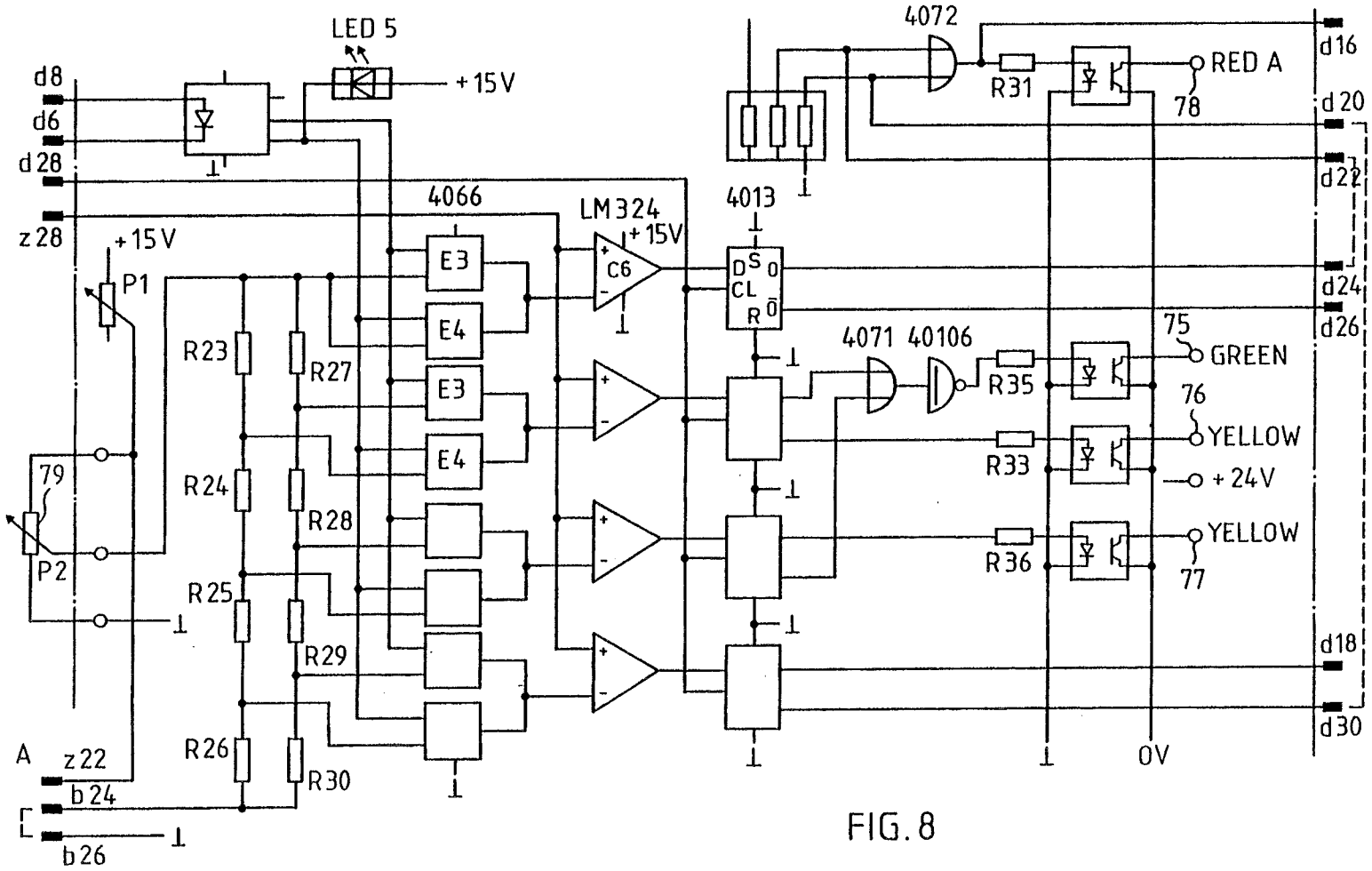

FIGS. *3a* to *3d* show various places where errors have occurred in an imbricated formation, with the corresponding measuring signals of an exemplary observation element;

FIG. 4 shows a block diagram of an exemplary embodiment of the interpretation element;

FIG. 5 shows a diagram for the calibration of an interpretation element;

FIG. 6 shows a block diagram of an exemplary embodiment of the control element;

FIG. 7 shows an operator control panel for an exemplary embodiment of a combined interpretation and control element;

FIG. 8 shows wiring of an exemplary calibration and error-detection function.

Figure 1:
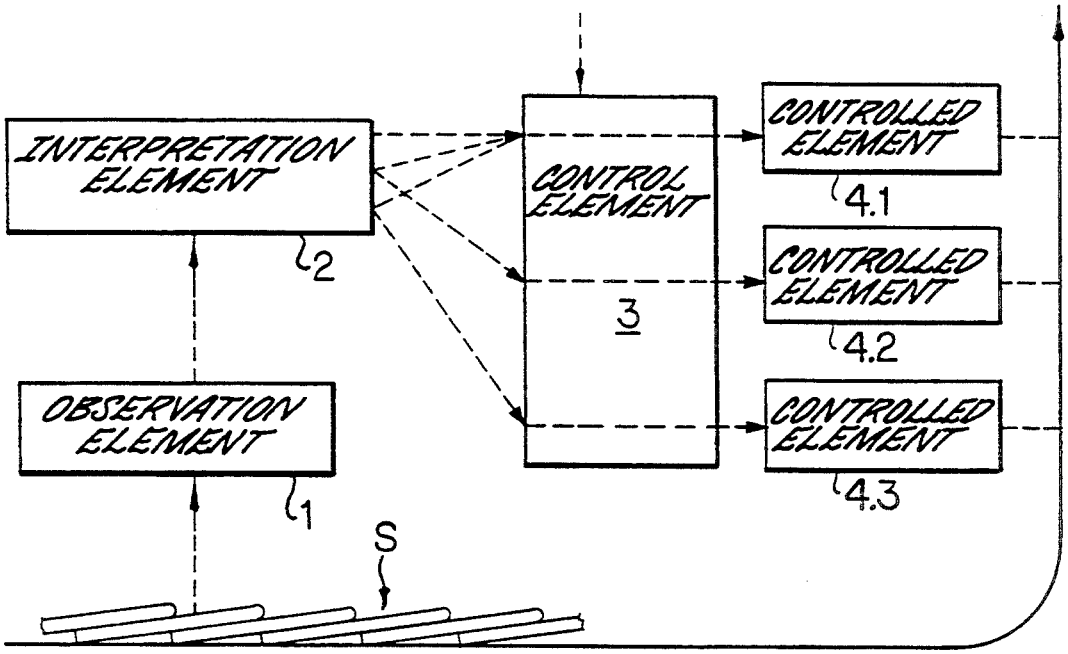
FIG. 1 shows a functional diagram of the error management system according to the invention.

FIG. 1 shows a basic functional diagram of the error management system according to the invention. This has an observation element 1, an interpretation element 2, a control element 3 and at least one controlled element 4.1, 4.2 and 4.3. The observation element 1 is arranged in the region of the imbricated stream S. The controlled elements 4.1/2/3 are, if at all possible, elements which serve for the transporting, further processing or conversion into other transporting formations and which, as far as possible, are specially equipped for their additional function of dealing with errors, in particular are controllable. They are all arranged downstream from the observation element in the stream of products.

The observation element 1 observes the imbricated stream S passed on for further processing and delivers to the interpretation element 2 a measuring signal corresponding to the imbricated stream. The interpretation element 2 compares the measuring signal of the observation element 1 with corresponding set values and, on the basis of this comparison, detects places where errors have occurred in the imbricated stream, which it also assigns to various types of error depending on the form they take (gap, missing product, displaced product or place occupied by more than one product). If the interpretation element detects an error, it generates an error pulse and, depending on the type of error, sends it to at least one input of the control element 3, assigned to a particular controlled element. The control element 3 generates from the error pulse a control pulse for the controlled element (4.1, 4.2 or 4.3) and delays said pulse according to the time period required for transporting the place where the error has occurred from the observation point to the controlled element, in such a way that the reaction of the controlled element brought about by the control pulse commences when the place where the error has occurred passes the effective area of said element. The reaction of the controlled element consists in transforming a place where an error has occurred and cannot be directly eliminated into one which can be eliminated (eject defective or multiple product, whereby a gap is created), eliminating a place where an error has occurred and can be eliminated (close gap) and/or suppressing further processing of the place where the error has occurred (allow place where the error has occurred to pass through the further processing stage without further processing).

For detecting and interpreting places where errors have occurred, the interpretation element 2 needs set values and tolerance ranges, which have to be matched to the product to be processed (for example product thickness) and to the imbricated stream to be processed (for example type of overlapping, product spacing). Set values are, for example, created by calibration measurements and stored or entered and stored. Tolerance ranges are likewise entered and stored or are permanently predetermined in the interpretation element. The interpretation element may also be of a self-learning design.

For generating the control pulses and their delay, the control unit requires data on the controlled elements and on the arrangement (with respect to the product stream) of the observation element and of the controlled elements (for example distance from the area of the observation element to the area of the controlled element in the number of clocks necessary for transporting ever this distance) and data on the products to be processed (for example product length). These data are also entered and stored in the control element or are permanently predetermined therein.

The control element may be sent additional error pulses from an apparatus arranged further upstream in the stream of products, for example messages from the rotary press concerning gaps caused by rejects or concerning technical malfunctions in printing, which could result in defective products. The control element processes such messages in the same way as error signals of the interpretation element, taking into account the distance between the element sending the message and the controlled element.

The error management system is subjected to the same system clock to which all the transporting and further processing elements in the effective area of the system also have to be subjected. Therefore, also in the case of a functional connection between, for example, rotary press and a controlled element of the error management system, it is a precondition that the timing of the rate of the imbricated stream between the rotary press and the controlled element is not reset.

By appropriately controlling apparatuses which are advantageously likewise necessary for further processing, the system according to the invention allows errors of the in-running imbricated stream to be application-specifically eliminated, transformed and/or allowed to run through further processing in such a way that no, or at most tolerable, defective products are produced.

Therefore, the embodiments of observation element, interpretation element, control element and controlled elements may be different, application-specifically, but their functions remain the same.

The errors which can be detected by the error management system according to the invention are principally: gaps in the imbricated stream, places in the imbricated stream occupied by an incorrect number of products (more than one), places in the imbricated stream occupied by defective products, and products which are positioned with respect to neighboring products with such a degree of displacement in the conveying direction that they cannot be further processed without correction.

The error management system according to the invention deals with gaps, for example, by closing them, or controls further processing in such a way that the gap passes without further processing. It deals with places occupied by a defective product by, for example, ejecting the defective product and dealing further in the way mentioned with the gap created as a result. It deals with places occupied by more than one product for example in the same way as places occupied by a defective product, or ignores them if they are eliminated in a following imbrication buffer. It deals with places with a displaced product as a gap with an immediately preceding or immediately following place occupied by more than one product or ignores them, depending on the size of the displacement.

Figure 2:
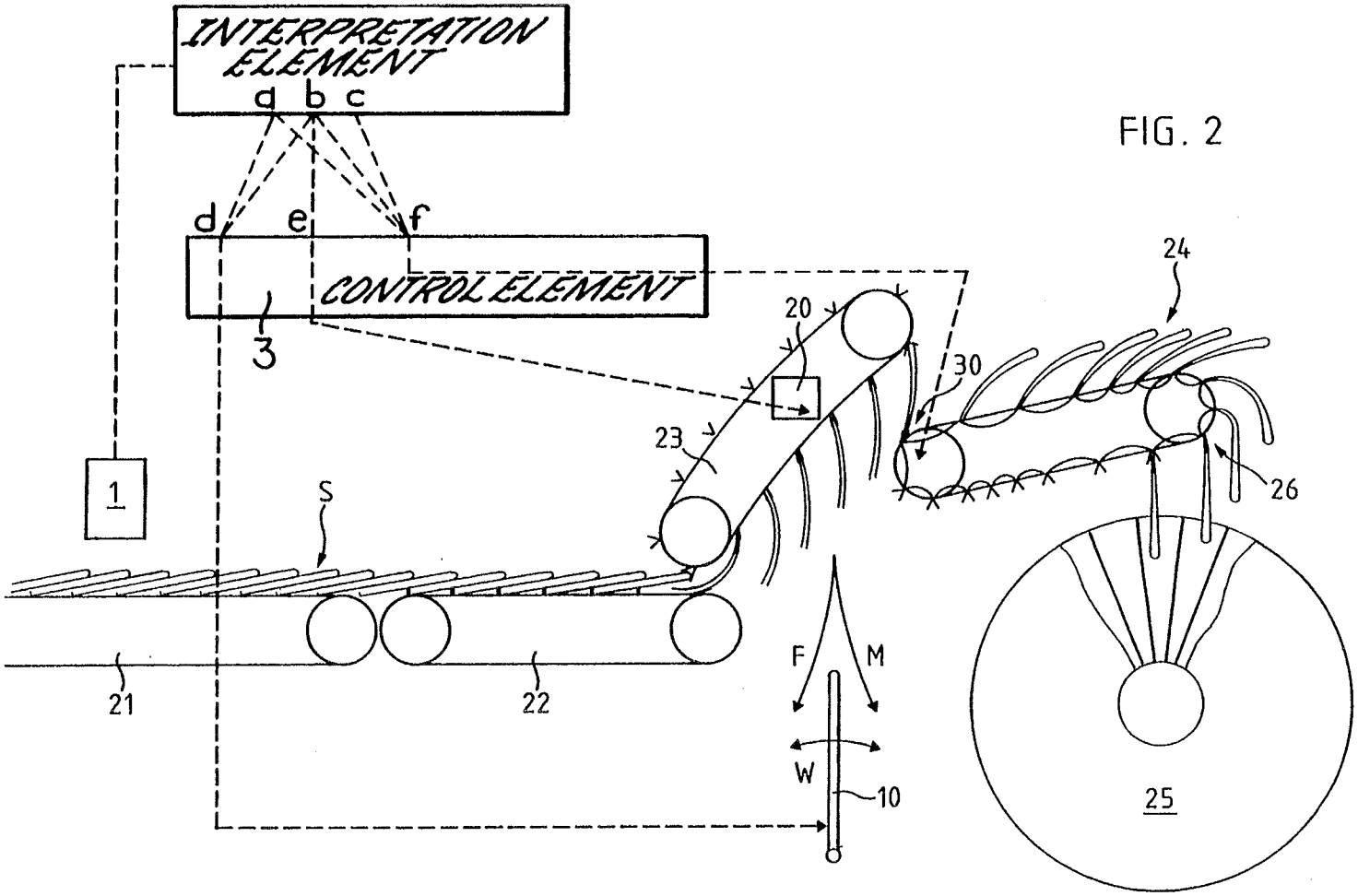
FIG. 2 shows an exemplary application of the error management system according to the invention.

FIG. 2 shows an exemplary application of the error management system according to the invention. For this application, the observation element 1 and the interpretation element 2 are, for example, equipped in such a way that it is possible to distinguish gaps, places occupied by more than one product and places occupied by a defective product. The imbricated stream runs into the area of the error management system on a conveyor belt 21, in the area of which the observation element 1 is arranged. It is then taken over by a clock-presetting element 22, on which the products are positioned exactly in the conveying direction by cams acting on the trailing edges of the products. Products which are displaced to a considerable degree are transformed by the clock-presetting element 22 into places occupied by more than one product and corresponding gaps, for which reason the error management system does not need to be set up for detecting displaced products. From the clock-presetting element 22, the imbricated stream is taken over by a clip or gripper transporter 23, and transferred from the latter to a clip or gripper buffer 24, which delivers the products to an insertion drum 25. The controlled elements are a diverter 10, which separates ejected products into defective products and multiple products, a triggering unit 20, which acts on the clips of the clip transporter 23, so that they can be opened by means of the diverter 10, and a controlled take-over of the products by the clips of the clip buffer 24 at its entry 30.

The triggering unit 20 opens the clips or grippers which have seized an incorrect number of products (place occupied by more than one product) or a defective product. Depending on its position (double-headed arrow W), the diverter 10 directs the ejected defective products according to arrow F, for example out of the process, the products from places occupied by more than one product according to arrow M, for example into a return to the process. The ejection creates a gap in the stream of products. At the controlled entry 30 to the clip buffer 24, no clip is further transported if the corresponding clip of the transporter 23 has no product to transfer (gap), whereby gaps are closed.

The function of the error management system for the application represented in FIG. 2 is thus as follows: the imbricated stream affected by places where errors have occurred passes the observation point with the observation element 1. The observation element delivers a measuring signal to the interpretation element 2. The interpretation element generates error signals for places (a) occupied by a defective product, for places (b) occupied by more than one product and for gaps (c). These error pulses are passed on to inputs of the control element 3, which are each assigned (d, e, f) to one of the controlled elements (10, 20, 30), to be precise: for places (a) occupied by a defective product, to the input d for a positioning of the diverter 10 to the right in the figure, in such a way that the defective product can be taken away to the left of the diverter, according to arrow F, out of the process, to the input e for the triggering unit for opening the clip which is transporting the defective product, and to the input f for closing the space created by the ejection; for places (b) occupied by more than one product, to the input d for a positioning of the diverter 10 to the left in the figure, in such a way that the products can be taken to the right of the diverter, according to arrow M, for example for returning to the process, to the input e for the triggering unit for opening the clip which is transporting the incorrect number of products and to the input f for closing the space created; for gaps, to the output f for closing the space.

At the exit 26 of the clip buffer, where the products are, for example, introduced into an insertion drum 25, a stream of products which has no defective products, no multiple products and no gaps is available.

The arrangement represented is just an example of one application, an unlimited number of others being conceivable. Even the application represented could function differently than the way described: for example, the defective products could also be ejected at the transfer from the clock presetter 22 to the clip transporter 23, so that the triggering unit 20 would then only have to transform places occupied by more than one product into gaps and the diverter 10 would be superfluous. Since, however, the clip control at a transfer point is usually realized by means of a movement template so slowly that several clips respectively in different states of closing move in the area of the template, the outlay for controlling individual clips which should not close in this area would be greater than for controlling the triggering unit 20. Of course, it would also be possible to use instead the one triggering unit 20 and the diverter 10 two triggering units and no The observation element 2 is generally an element which observes the imbricated stream. Observation elements may be classified in two groups: those which deliver a clocked signal, that is to say a signal which produces a meaningful measurement result once per system clock, and those which deliver a continuous signal. An observation element may, for example, measure the thickness of the complete imbricated stream or the thickness of each element of the imbricated stream.

Examples of apparatuses which measure thicknesses and can be used as observation elements are:

- a scanning roller, the deflection of which with respect to a position of rest (zero position) is sensed as a measuring signal and which delivers a continuous measuring signal, correlated with the overall thickness of the imbricated stream;
- an apparatus according to German Offenlegungsschrift No. 3419436 and U.S. Pat. No. 4,560,159 of the same applicant, which delivers a clocked measuring signal, correlated with the thickness of the complete imbricated stream; an apparatus according to Swiss patent application No. 510/92 and U.S. Pat. application Ser. No. 08/018,826, now U.S. Pat. No. 5,356,130, of the same applicant, which essentially delivers a continuous measuring signal, correlated with the product edges lying on top of the imbricated stream;
- an apparatus according to Swiss patent application No. 3231/90 and U.S. Pat. No. 5,154,279 of the same applicant, which delivers a clocked measuring signal, correlated with the thickness of the respectively uppermost product of the imbricated stream.

Other apparatuses can also be used as observation element 1, for example sensory arrangements by which the distance between the imbricated stream and a fixed reference point is contactlessly measured continuously or in a clocked manner, sensory arrangements by which patterns on the upper side of the imbricated stream are sensed, or many others besides.

FIGS. 3*a* to 3*d* then show, by way of example, the measuring signal of an observation element 1, which corresponds to the apparatus according to Swiss patent application No. 510/92 and U.S. application Ser. No. 08-018,826 in the case of various places where errors have occurred in the imbricated stream. For a detailed description, you are referred to the corresponding application.

Figure 3A:
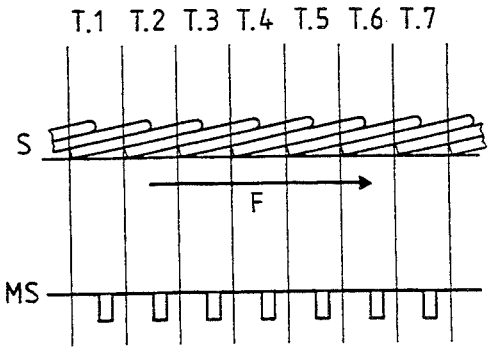

FIG. 3*a* shows over an observation time of seven clocks (T.1 to T.7) an error-free imbricated stream S with conveying direction F and the corresponding, continuous signal MS of the observation point. The measuring signal MS has in each clock for the edges of the printed products lying on top of the imbricated stream a deflection which corresponds in the timing of its occurrence within the clock to the position of this leading edge in the imbricated stream, and in its amplitude to the thickness of the product in the edge region.

Figure 3B:
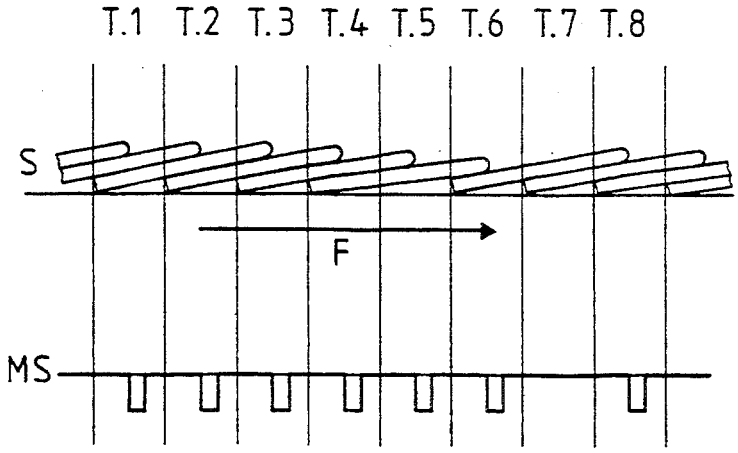

FIG. 3*b* shows in comparison with FIG. 3*a* an imbricate stream S which has a gap in clock T.7. Accordingly, in clock T.7 there is no deflection of the measuring signal. Thus, a gap can be detected by an interpretation element by said element scanning the measuring signal MS clock by clock for an edge. If the edge is missing in a clock, an error pulse for a gap is generated. Instead of edge scanning, amplitude scanning may also be used in order to detect a gap. In this case, in the event of a gap, the amplitude achieved as a maximum by the measuring signal within the clock is below a lower tolerance limit (see description of FIG. 3*c*).

Figure 3C:
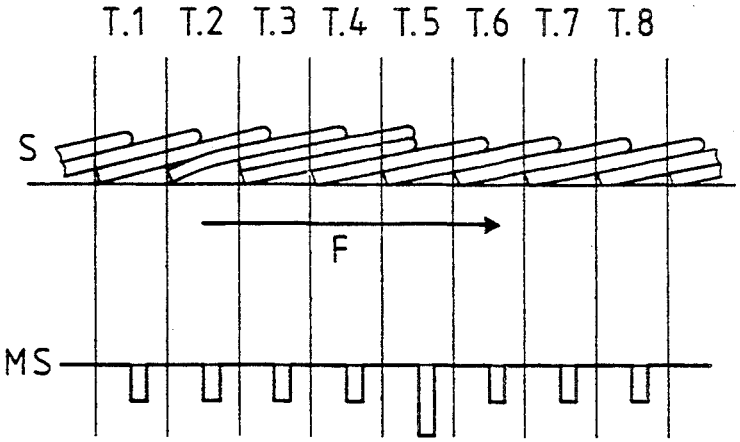

FIG. 3*c* shows an imbricated stream with a place occupied by two products in clock T.5. Accordingly, the deflection of the measuring signal in clock T.5 shows a doubled amplitude. For a product of defective thickness (missing or excess pages), the amplitude of the deflection is correspondingly high. Thus, for detecting places occupied by more than one product or incorrectly occupied, a scanning of the deflection amplitude can be used. According to the tolerance ranges set, for example double products can be detected in a stream of single products, single or more than doubled products can be detected in a stream of double products and/or defective products can be detected in any stream.

It is shown that, for detecting double products and gaps in a stream of single products (without detecting defective products) a tolerance range of $+75\%/-50\%$ (referred to the thickness of the product) is sufficient. If the measured thickness is more than 175%, there are two products, if it is less than 50%, there is no product. For detecting places occupied by an incorrect number products in a stream of double products, for example a tolerance range of $\pm 45\%$ (referred to the thickness of two products) is used. If the measured thickness is more than 145%, there are three or more products, if it is less than 55%, there is one product or no product.

Figure 3D:
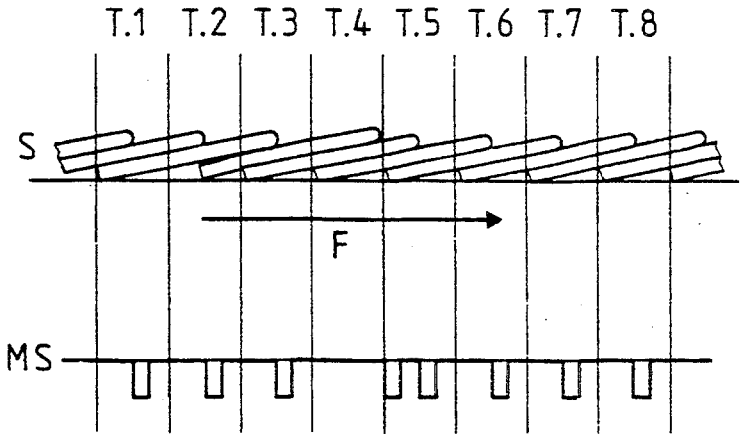

FIG. 3*d* shows an imbricated stream in which the product in clock T.4 is displaced in such a way that the corresponding deflection occurs in clock T.5 and clock T.4 has to be interpreted as a gap. If the measuring signal is also scanned clock by clock for doubled edges, a displaced product can be detected as a clock without deflection (T.4) with an immediately following or immediately preceding clock with a double edge. If the phase displacement between system clock and imbricated stream at the observation point is such that the edge of the product occurs in the middle of the system clock, the tolerance range of such a detection is about ±50% (referred to the spacing between the products), that is to say a detection by more than half of the set spacing is detected as a displaced product. For reducing the tolerance range, the system clock may be divided up into two regions, an edge being expected in the one region of the clock, not in the other region.

Different observation elements deliver different measuring signals. With observation elements which continuously measure a variable correlating with the thickness of the stream ok of the individual products, all the errors mentioned can be detected by an edge scanning and an amplitude scanning per system clock if the measuring accuracy is adequate. With observation elements which deliver a clocked measuring signal, said signal is expediently scanned only for amplitude, that is to say that, for example, such a signal cannot be used to differentiate between a considerably displaced product and a gap combined with a double product. For this reason, observation elements which deliver clocked measuring signals are advantageously used on imbricated streams of which the timing of their clocked rate is good.

Measuring signals which are correlated with the complete thickness of the imbricated stream are more complicated to process, since places where errors have occurred extend over more then one clock, which is obvious in particular at the beginning and end of an imbricated stream and where there are major interruptions. If this also has to be allowed for in the interpretation of the measurement, the set values for clocks following a place where an error has occurred must be changed according to the length of the product and according to the place of the error.

FIG. 4 then shows an exemplary block diagram of an interpretation element 2 for interpretation of the measuring signal of an observation element in the form of an apparatus according to Swiss application No. 510/92 and U.S. application Ser. No. 08/018,826, now U.S. Pat. No. 5,356,130 , as could also be used in the application of FIG. 2. Let the imbricated stream be, for example, a stream of doubled products, the observation element delivers a continuous measuring signal MS. This is correlated with the height of the product edges lying on top of the imbricated stream. The measuring signal is processed clock by clock by the interpretation unit, that is to say a clock is interpreted as defective in terms of a certain type of error and a corresponding error signal is generated or it is interpreted as good and no error signal is generated.

The measuring signal MS is fed to an edge scanning 41, in which it is scanned clock by clock for the number of edges occurring. If a clock has no edge, an error signal for a gap (see FIG. 2) is generated, if it has more than one edge, an error signal for a displaced product (which is to be dealt with, for example, as a place occupied by more than one product, b, FIG. 2) is generated. The measuring signal is fed furthermore to a first, approximate amplitude scanning 42. If the amplitude reached as a maximum in a clock lies outside the tolerance range, an error signal for a place occupied by an incorrect number of products (b, FIG. 2) is generated. Thereafter, the measuring signal is also fed to a second amplitude scanning 43, with a significantly narrower tolerance range. If the amplitude lies outside the tolerance range, an error signal for a defective product (a, FIG. 2) is generated. For a clock which has an edge and an amplitude lying within the narrow tolerance, a pulse can be generated for a counter Z, so that the counter counts out all the good places of the imbricated stream.

If the same arrangement is used to handle a stream of individual products, in the first amplitude scanning 42 an amplitude below the lower tolerance limit must be interpreted as a gap (c). If defective products and multiple products are to be ejected at the same point, the approximate amplitude scanning 42 is superfluous. If defective products are not detected, the second, fine amplitude scanning 43 is superfluous.

If the imbricated stream handled is a differentiated stream, in which for example pairs of products are conveyed, the product spacing within the pair being less than between pairs, two edges or no edge occur alternately in a system clock. The edge scanning can then be set up in such a way that error signals are generated if edges occur in the blank clock and if more or less than two edges occur in the other clock. For differentiated streams as well, the system clock may be divided into clock regions in such a way that a pattern of clock regions with edge and clock regions without edge is produced.

If the observation element delivers a clocked signal, the edge scanning is dispensed with and displaced products are not detected or detected as a combination of a place occupied by more than one product and a gap, depending on the size of the displacement. If the measuring resolution of the observation element is not great enough or the background of the measurement is noisy, the detection of defective product (missing pages etc.) becomes difficult or impossible. If the measuring signal is correlated with the thickness of the complete imbricated stream, the interpretation of the amplitude scanning must be adjusted not only to the product lying uppermost in the imbricated stream but also to all the products lying underneath.

Depending on the type of design, the observation element may deliver an analog measuring signal or a digital measuring signal. The functions of the interpretation element may be realized by hardware or software. In both cases, the necessary functions of the possibly necessary conversion of the measuring signal (for example analog/digital convertor), of the edge scanning (for example flip-flop circuit) and of the amplitude scanning (for example comparator circuit) correspond to the prior art and do not have to be described here in detail.

For an analog measuring signal in the form of a measuring voltage U and a hardware interpretation unit, the limit values for the amplitude scanning are determined, for example, by potentiometers which are connected upstream of the set-value inputs of the comparators, and/or by fixed resistors. In the case of a calibrating measurement, the thickness of the product can be sensed by the observation element and the corresponding average set value can be set in the form of a reference voltage by the settings of a potentiometer. FIG. 5 diagrammatically shows the setting of this set value. The product thickness D is plotted to the left, the reference voltage UV is plotted to the right on the X axis. Each reference voltage is assigned, for example, two upper and two lower tolerance limits TG.1/2/3/4. The measuring voltage U is plotted on the Y axis.

Let the thickness of a product measured in a calibrating measurement be $D_0$, the sensing of which by the observation element is produced by a measuring voltage $U_0$. The reference voltage is then set, for example, by the comparison of U and UV giving a result within the closer tolerance limits TG.1 and TG.2. Consequently, the set value $UV_0$ and the corresponding tolerance limits $TG_0$.1/2/3/4 are determined. In the scanning of the imbricated stream, the set value $UV_0$ is kept constant and the corresponding tolerance limits $TG_0$.3 and $TG_0$.4 are compared with the effective, constantly changing measured value U.

FIG. 6 shows a block diagram of an exemplary control element 3. The control element generates from the error pulses produced by the interpretation element control pulses for the controlled elements in a way that it delays them essentially according to the distance between observation point of the observation element and point of action of the controlled element, and if necessary converts them to be suitable for driving the controlled element. The distance between the two points is processed as the number of system clocks necessary for conveying a product from one point to the other.

If the observation element observes the same product edge (leading or trailing edge) on which the controlled element is acting, the necessary delay corresponds to the effective distance between observation point and point of action. If the leading edge is observed and it is acting on the trailing edge, the effective distance between observation point and point of action must be enlarged by the length of the product. If the trailing edge is observed and it acts on the leading edge, the effective distance between observation point and point of action must be shortened by the length of the product.

In order that the delays can be adapted as accurately as possible to the distances and the length of the product, it is advantageous to divide the system clock for the control unit.

The block diagram represented in FIG. 6 applies, for example, for the control element which is used for the exemplary application represented in FIG. 2, but it may also be used likewise for other applications with three or less controlled elements. The inputs for error pulses are denoted in a way corresponding to FIG. 2 by the designations d, e and f, the outputs for the control pulses are denoted by the designations of the controlled elements 10, 20 and 30. The control element also has an input L for entering the length of the product, which has to be converted into clocks in a converting element 61. It also has an input for the system clock T, which is advantageously converted by a divider 62 into a faster control clock. The control element essentially comprises parallel-functioning units, which each bring about the delay of a control pulse intended for a particular controlled element. These units comprise a first delay unit 63, which brings about a delay by the length of the product and can optionally be bypassed (switch 64), and a second delay unit 65, which is set according to the distance between observation point and point of action of the corresponding controlled element (input 66). The block diagram represented cannot be used for controlling a controlled element which acts on the leading edge while the trailing edge is observed (negative delay).

For the application according to FIG. 2, the switches 64 for the inputs d and e must be set to bypass and the corresponding switch for the input f must be set to the first delay unit, since the leading edges are being observed, the controlled elements 10 and 20 are acting on the leading edges and only the controlled element 30 is acting on the trailing edges.

The control element may be realized by hardware, for example by shift registers which can be set correspondingly. It may also be realized by software.

FIG. 7 shows the operator-control and setting panel for a combined, hardware interpretation and control element. It is evident from this which parameters can be set, which are permanently wired. The corresponding combined element can be used for the controlled elimination of places occupied by more than one product from imbricated streams of individual products or of double products.

In the right-hand part, three selector buttons 71, 72 and 73 are fitted. With selector button 71 the amplitude scanning of the interpretation unit is activated, with selector button 72 the edge scanning. Edge-scanning and/or amplitude scanning can be activated. With selector button 73, a delay dependent on the length of the product can be activated/deactivated. In the central part, the figure shows an input point 74 for entering the length of the product.

The left-hand region of the panel serves the calibration measurement and the optical display of places where errors have occurred. It comprises an arrangement of light-emitting diodes 75, 76, 77 and 78 and a balancing knob 79. The light-emitting diodes are wired to the comparators in such a way (see FIG. 8) that the green light-emitting diode (75) lights up if the measured value lies within the tolerance limits TG.1 and TG.2 (FIG. 5). The yellow light-emitting diodes 76 and 77 light up if the measured value lies between TG.2 and TG.3 or between TG.1 and TG.4, respectively. The red light-emitting diode 78 lights up if the measured value lies outside the range between TG.3 and TG.4. The calibrating setting is performed by the observation element sensing a product or a number of products corresponding to the imbricated stream and by the balancing knob 79 being set in such a way that the green light-emitting diode 75 and the two yellow light-emitting diodes 76 and 77 light up. During operation, the position of the balancing knob 79 is no longer changed. The diodes light up according to the measurement, in particular lighting up of the red diode 78 indicates a place where an error has occurred.

FIG. 8 shows the wiring of the calibrating and error detection function (amplitude scanning) on which this region (75, 76, 77, 78, 79) of the panel described in conjunction with FIG. 7 and its function are based.

The controlled elements are usually known elements which do not have to be described here in any more detail. Most suitable for ejecting defective products or multiple products is a triggering unit which acts on a clip which is transporting such a product. Clips which can be actuated individually by a triggering unit are known, for example, from Swiss patent 644816, U.S. Pat. No. 4,381,056 of the same applicant. As already mentioned, it is more advantageous for the products to be ejected to be seized at a transfer by a clip and for the clip to be opened later by a triggering unit than not to close at the transfer. As triggering unit, use may be made for example of a corresponding arrangement with a quick-acting cylinder, which acts on the triggering mechanism of the clip.

For closing spaces, as shown in FIG. 2, a clip buffer may be used. A corresponding clip buffer is known from American patent No. U.S. Pat. No. 4,887,809 (F245) of the same applicant. Of course, other types of buffers or space closers may also be used. However, it is advantageous to arrange the spaces at the end of the effective area of the error management system and to choose such an embodiment of a space-closing apparatus for which, as far as possible, the stream of products does not have to be brought into a different transporting formation and for which it is not possible that, for example, places occupied by more than one product occur again.

It goes without saying that a plurality of error management systems, as have been described, can also operate together in parallel or in series. In particular, a parallel combination of error management systems is conceivable for a further processing system in which a plurality of imbricated streams run together, such as for example for inserting or collating. In this case, all the imbricated streams can be handled by one error management system each, it being possible to send error pulses from one imbricated stream also to controlled elements of the other imbricated streams, for example to prevent the production of defective products.

That which is claimed is:

1. A system for detecting and treating errors in an imbricated stream of sheet-like products, comprising:

conveying means (21, 22, 23, 24) for conveying said imbricated product stream (S) in a conveying direction and defining a conveying path, an observation element (1) arranged adjacent to said conveying path and provided with means for scanning the imbricated product stream (S) passing by and for generating a correlated measuring signal (MS), an interpretation element (2) connected to said observation element (1) so as to receive the measuring signal (MS) and including means for the interpretation of said measuring signal (MS) so as to detect each of a plurality of possible errors in the imbricated stream, and for generating error signals based on the interpretation and which are characteristic of the particular error detected, a control element (3) connected to said interpretation element (2) so as to receive the error signals and being provided with means for generating different control signals which are correlated with the different error signals received, a plurality of controlled elements (4.1, 4.2, 4.3, 10, 20, 30) connected to said control element (3) and so that each controlled element receives a particular one of the different control signals, said controlled elements being arranged downstream from said observation element and being provided with means for responding to the receipt of a particular control signal so as to eliminate the detected error or minimize its effect, and a single clock system for controlling each of said interpretation element, said control element, and said controlled elements.

2. The system for error management as claimed in claim 1, wherein the observation element (1) is a sensor arrangement for the clocked generation of a measuring signal correlated with the thickness of the products conveyed in the imbricated stream, which arrangement is likewise subjected to the system clock.

3. The system for error management as claimed in claim 1, wherein the observation element (1) is a sensor arrangement for the continuous generation of a measuring signal (MS) correlated with the thickness of the products conveyed in the imbricated stream.

4. The system for error management as claimed in claim 3, wherein the measuring signal of the observation element is correlated with the thickness of the edge of the printed products lying on top of the imbricated stream.

5. The system for error management as claimed in claim 1, wherein the interpretation element (2) has scanning and comparing means (42, 43) for clock-by-clock scanning of the measuring signal for amplitude, and for comparing the measuring signal amplitude with at least one tolerance limit.

6. The system for error management as claimed in claim 5, wherein the interpretation element (2) has input means for entering tolerance limits.

7. The system for error management as claimed in claim 5, wherein the interpretation means (2) has setting means (79) for setting set values, to which tolerance limits are permanently assigned, corresponding to a calibrating measurement.

8. The system for error management as claimed in claim 5, wherein the interpretation element (2) has both means (42, 43) for a clock-by-clock amplitude scanning and means for an edge scanning (41) and wherein it additionally has switching means (71, 72) for the optional activating or deactivating of the scanning means.

9. The system for error management as claimed in claim 8, wherein the control unit (3) has at least one further delay means (63), which can be set according to the length of the product.

10. The system for error management as claimed in claim 1, wherein the interpretation element (2) has means for edge scanning (41) the measuring signal.

11. The system for error management as claimed in claim 1, wherein the control element (3) has at least one delay means (65) for delaying an error signal generated by the interpretation element.

12. The system for error management as claimed in claim 11, wherein the delay means (65) can be set according to the distance between the observation point of the observation element and a controlled element.

13. The system for error management as claimed in claim 10, wherein the delay means (63, 65) are shift registers.

14. The system for error management as claimed in claim 10, wherein the controlled element (3) has a clock divider (62).

15. The system for error management as claimed in claim 1, wherein the controlled element or elements (4.1, 4.2, 4.3, 10, 20, 30) has/have controlled means for closing spaces, for ejecting products or for interrupting further processing.

16. The system for error management as claimed in claim 15, wherein one controlled means is a triggering unit for the controlled opening of an individual transporting gripper.

17. The system for error management as claimed in claim 16, wherein the triggering unit has a quick-acting cylinder which acts in a controlled manner on the opening mechanism of a transporting gripper passing its area.

18. The system for error management as claimed in claim 15, wherein one controlled element is the entry of a gripper buffer.

19. The system for error management as claimed in claim 1, wherein the control element (3) also processes error pulses from other process units.

20. The system for error management as claimed in claim 19, wherein the control element (3) processes error pulses of the rotary printing press delivering the imbricated formation.

21. The system for error management as claimed in claim 1, wherein its controlled elements are also driven by other process units.

22. The system for error management as claimed in claim 21, wherein at least one of its controlled elements is at the same time a controlled element of other error management systems operating in a parallel combination.

* * * * *